US007886394B2

(12) United States Patent
Chen

(10) Patent No.: US 7,886,394 B2
(45) Date of Patent: Feb. 15, 2011

(54) BATH UTILITY

(76) Inventor: Shu-Han Chen, No. 257, Sec. 2, Wen Yuan Road, Pei Tou, Chang Hua Hsien (TW)

( * ) Notice: Subject to any disclaimer, the term of this patent is extended or adjusted under 35 U.S.C. 154(b) by 573 days.

(21) Appl. No.: 11/868,977

(22) Filed: Oct. 9, 2007

(65) Prior Publication Data

US 2009/0089946 A1 Apr. 9, 2009

(51) Int. Cl.
*A47L 13/10* (2006.01)
*A47K 7/02* (2006.01)

(52) U.S. Cl. ..... 15/104.001; 15/209.1; 15/229.11

(58) Field of Classification Search ..... 15/209.1, 15/229.11, 229.13; 601/136; *A47K 7/02; A47L 13/10*
See application file for complete search history.

(56) References Cited

U.S. PATENT DOCUMENTS 5,709,434 A 1/1998 Chen
6,092,258 A 7/2000 Chen
6,105,196 A * 8/2000 Chang ..... 15/209.1
6,112,363 A 9/2000 Chen
6,227,621 B1 5/2001 Chen
6,510,577 B1 * 1/2003 Borcherds et al. ..... 15/118
6,754,931 B2 6/2004 Chen
7,013,523 B2 * 3/2006 Chang ..... 15/209.1
2003/0145407 A1 * 8/2003 Chen ..... 15/209.1

* cited by examiner

*Primary Examiner*—Monica S Carter
*Assistant Examiner*—Stephanie Newton
(74) *Attorney, Agent, or Firm*—Ming Chow; Sinorica, LLC

(57) ABSTRACT

A bath utility includes a frame and several bath balls. The frame has a configuration of a wider top end and a narrower bottom end. The bath balls are respectively bound on the frame by means of several binding members. The adjacent bath balls are leant on each other to hide the frame in the bath balls. Accordingly, the bath utility has a specific pattern.

16 Claims, 9 Drawing Sheets

BATH UTILITY

BACKGROUND OF THE INVENTION

The present invention is related to a bath utility, and more particularly to a bath utility with novel pattern.

It is known that various bath implements are made of plastic-made mesh tubes. For example, U.S. Pat. No. 5,709,434 discloses a bath ball made of plastic mesh tube. U.S. Pat. No. 6,092,258 discloses a bath brush including a handle and a plastic mesh tube fixed on the handle. U.S. Pat. No. 6,227,621 discloses a bath ball structure which is made of a plastic mesh tube wound around an article. Also, U.S. Pat. No. 6,112,363 discloses a bath belt made of many plastic mesh tubes. U.S. Pat. No. 6,754,931 discloses a bath brush made of many plastic mesh tubes.

The bath implements of the above patents are used in bathing. However, these bath implements are just for bathing and lack novel configuration. For example, the bath ball of U.S. Pat. No. 5,709,434 simply has a form of a ball without a special figure. The bath belt of U.S. Pat. No. 6,112,363 is simply a belt-shaped bathing implement without any special pattern. The bath brush of U.S. Pat. No. 6,754,931 is made of a plastic mesh tube and several bath balls, in which the plastic mesh tube is wound into an annular main body and the bath balls are connected with the main body to surround the same. Such bath brush is completely made of soft plastic mesh tubes and the shape of which is randomly changeable. Therefore, such bath brush has no fixed configuration.

SUMMARY OF THE INVENTION

It is therefore a primary object of the present invention to provide a bath utility with novel pattern.

The bath utility includes: a frame having a configuration of a wider top end and a narrower bottom end; a predetermined number of bath balls made of plastic mesh tube, a center of each bath ball being tightly bound, while a periphery of the bath ball being bouffant; and a predetermined number of binding members for respectively binding the bath balls on the frame; the number of the bath balls arranged at the top end of the frame being more than the number of the bath balls arranged at the bottom end of the frame; the peripheries of each two adjacent bath balls being leant on each other to hide the frame in the bath balls. Accordingly, the bath utility has a novel and lovely pattern.

The present invention can be best understood through the following description and accompanying drawings wherein:

DETAILED DESCRIPTION OF THE PREFERRED EMBODIMENTS

Figure 1:
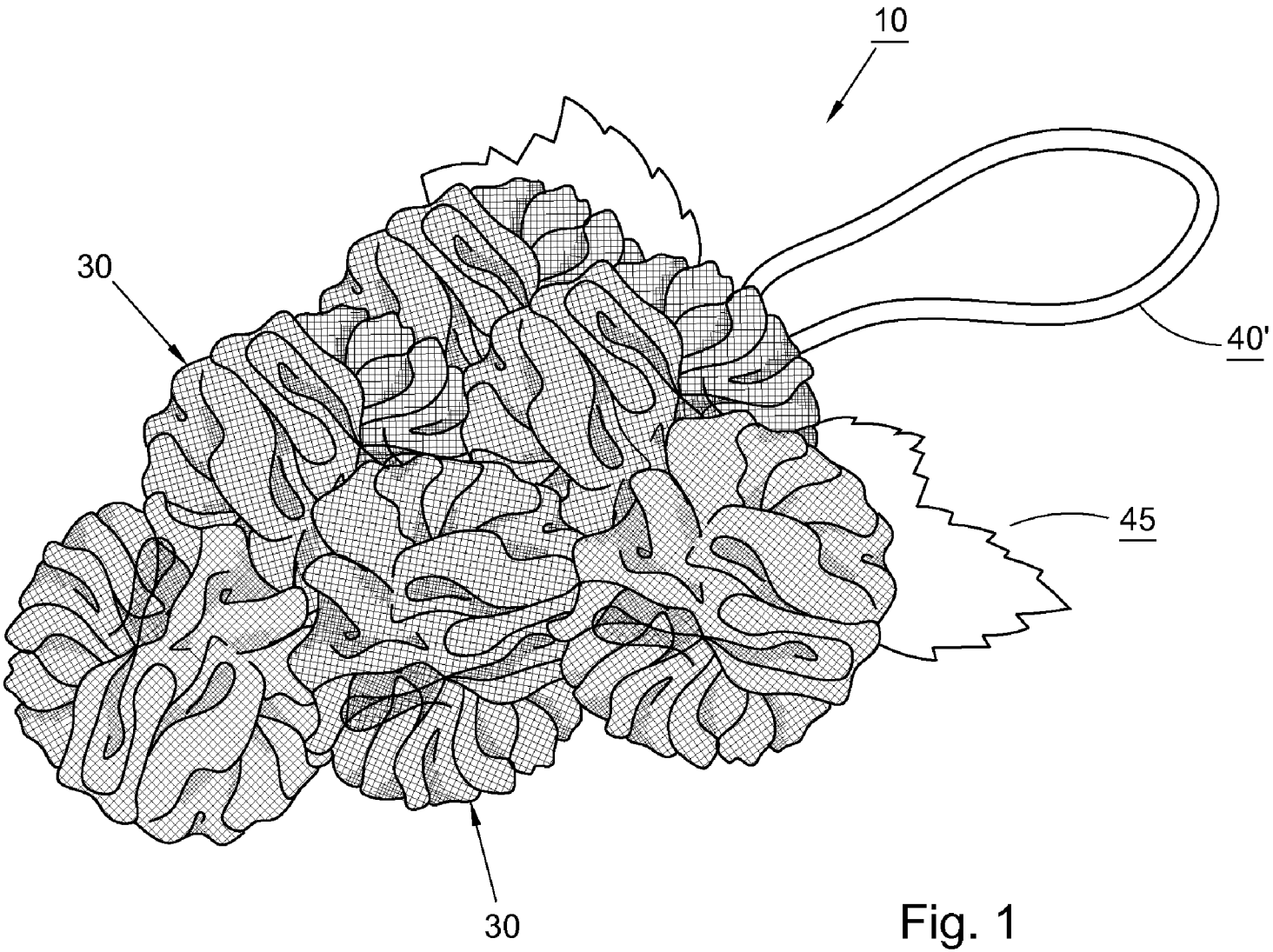
FIG. 1 is a perspective view of a first embodiment of the present invention.
Figure 2:
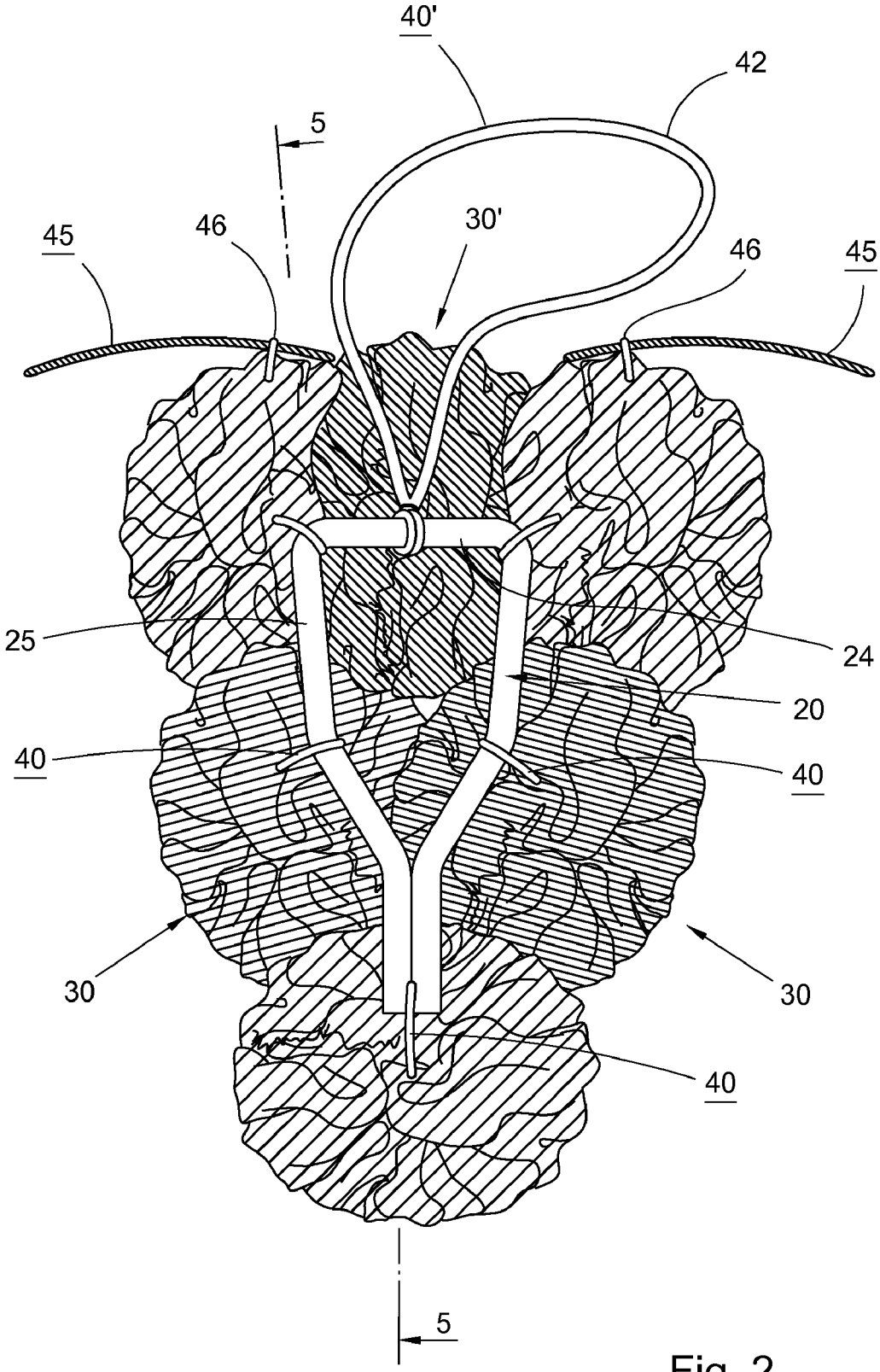
FIG. 2 is a longitudinal sectional view of the first embodiment of the present invention.

Please refer to FIGS. 1 and 2. According to a first embodiment, the bath utility 10 includes a frame 20 and several bath balls 30 connected with the frame 20.

Figure 3A:
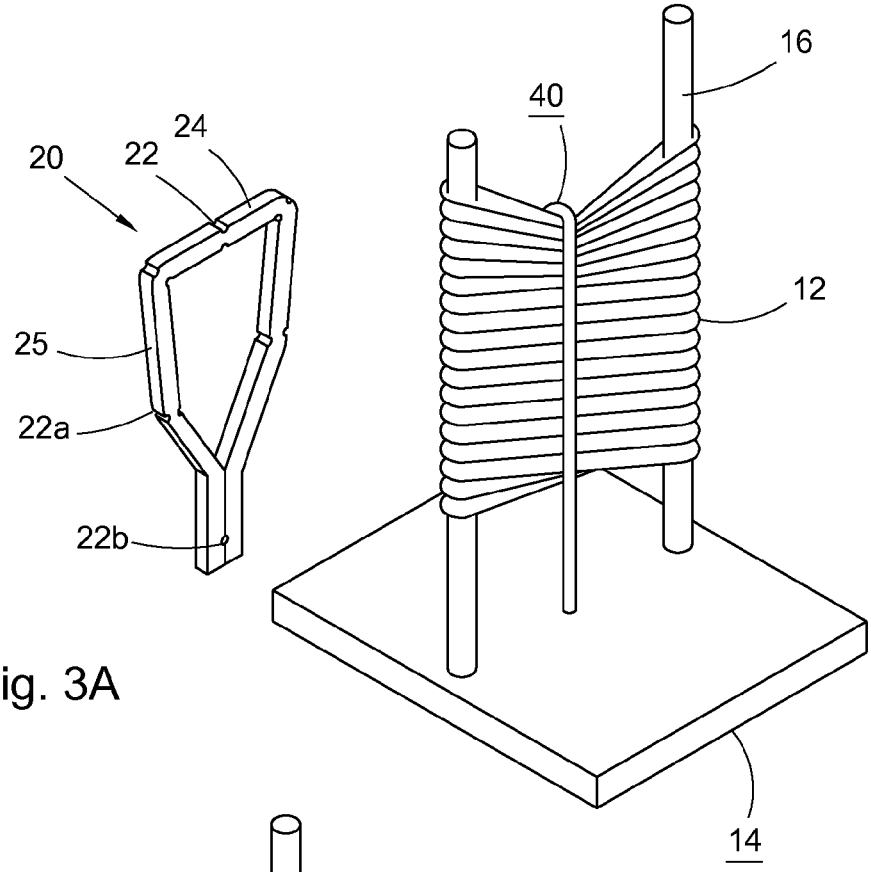
FIGS. 3A to 3D show the manufacturing procedure of the present invention.

The frame 20 has a fixed configuration and is preferably made of hard plastic. However, the material of the frame 20 is not limited. The frame 20 has a widest top end and a narrowest bottom end. For example, it can be triangular or trapezoid. In this embodiment, the frame 20 is a triangular frame. Referring to FIG. 3A, several locating sections 22 are formed on the frame 20 at intervals. For example, the middles of a top side 24 and two lateral sides 25 of the frame 20 are respectively formed with a locating section 22. In addition, three corners of the frame 20 are respectively formed with a locating section 22. Each locating section 22 can be a notch 22*a* or a hole 22*b* as shown.

Figure 3B:
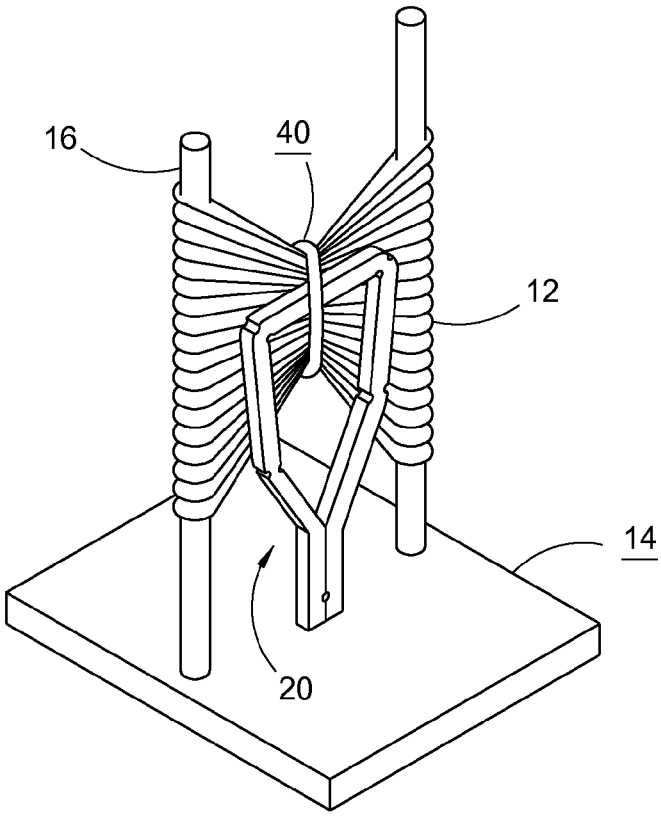
Figure 3C:
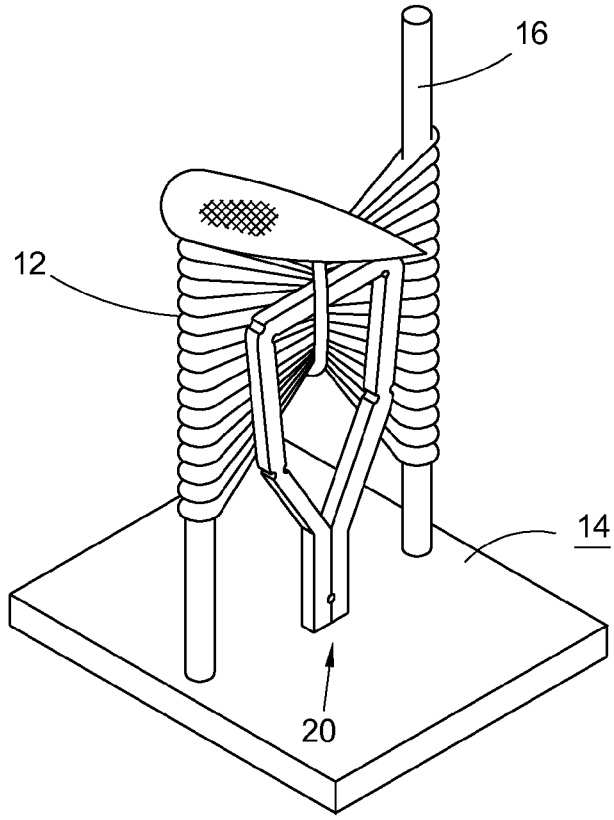
Figure 3D:
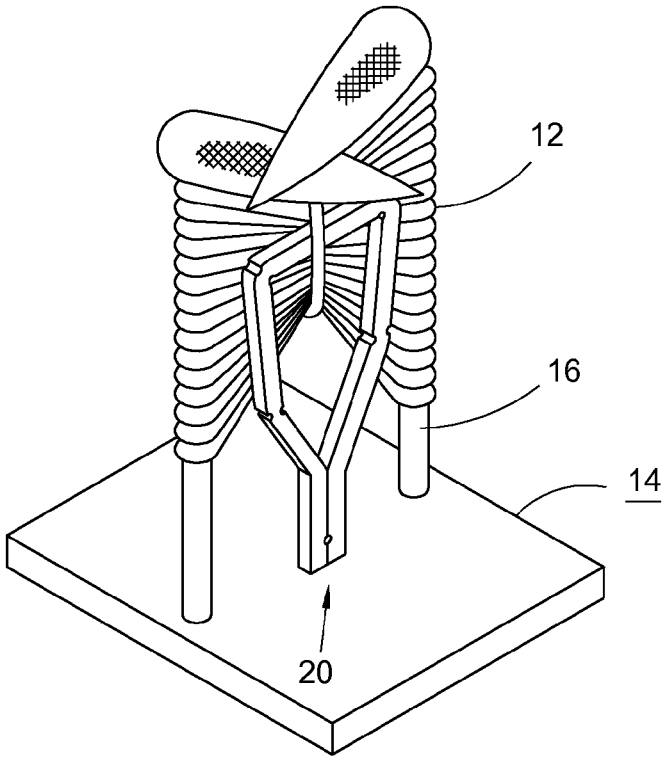
Figure 4:
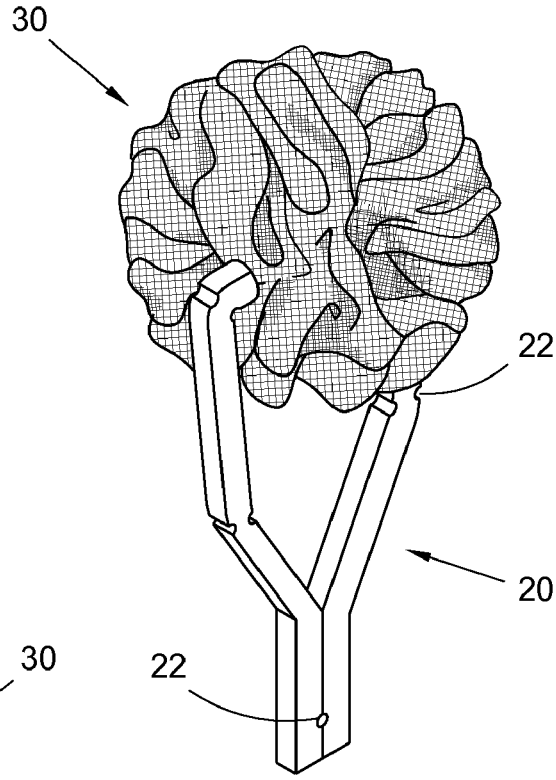
FIG. 4 shows a semi-product of the present invention according to the manufacturing procedure of FIGS. 3A to 3D.

The bath ball 30 is a spongy ball-shaped object made of plastic mesh tube. U.S. Pat. No. 5,709,434 discloses such a bath ball. However, this is not limited. Referring to FIG. 3A, a mesh tube 12 is fitted around two poles 16 of a tool 14. Then a binding member 40 is used to bind up the middle of the mesh tube 12. Also, the frame 20 is bound with the mesh tube 12 as shown in FIG. 3B. Then, as shown in FIGS. 3C and 3D, the mesh tube 12 is in turn drawn out from the two poles 16, whereby the mesh tube 12 forms a spongy bath ball 30 having multiple stacks of crimps, and the bath ball 30 is fixed on the frame 20 as shown in FIG. 4. This procedure is repeated, whereby multiple bath balls 30 can be connected with the frame 20.

Figure 5:
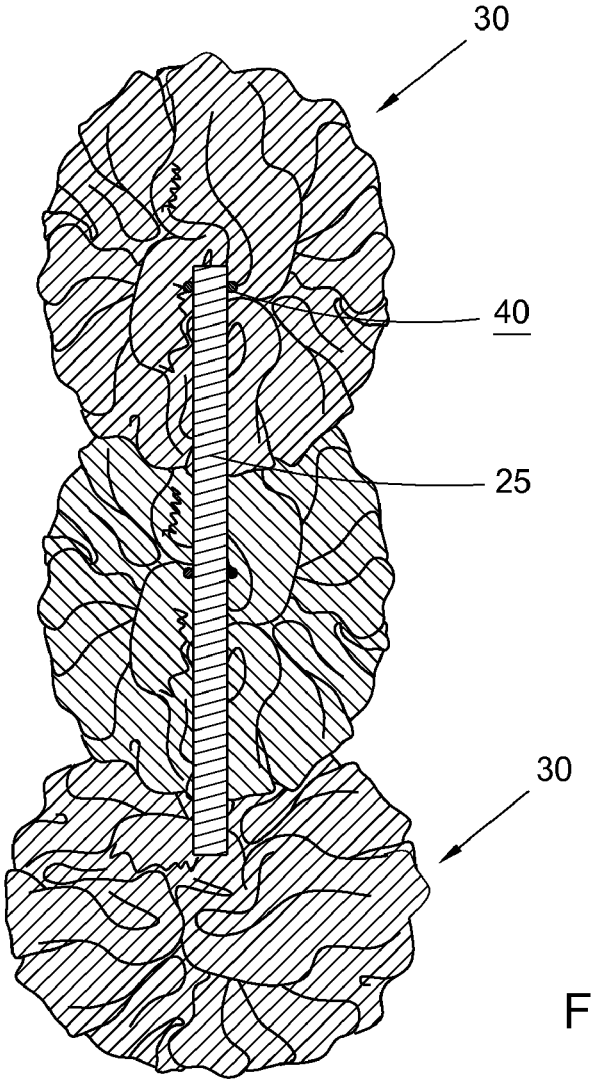
FIG. 5 is a sectional view taken along line 5-5 of FIG. 2.

Each bath ball 30 is bound on the frame 20 by means of a binding member 40. The binding member 40 is preferably a cord for binding the bath ball 30 at the locating section 22. Accordingly, the bath ball 30 is located at the locating section 22 without displacing. Referring to FIGS. 1, 2 and 5, the bath balls are bouffant so that the peripheries of two adjacent bath balls will overlap each other. Accordingly, the frame 20 is hidden in the bath balls 30 without being seen. This bath utility has a fixed profile.

Referring to FIG. 2, in practice, the binding member 40' for binding the bath ball 30' at the middle of the top side 24 of the frame 20 has a reserved loop section 42 with a certain length. Accordingly, the loop section 42 is exposed to outer side of the bath utility for a user to take and hang the bath utility.

In this embodiment, the bath utility further includes two fabric-made decorative sheets 45 in form of leaves. The decorative sheets 45 are stitched on top edges of two outermost bath balls 30 as shown in FIG. 2.

After made, the bath utility 10 of the embodiment has an upper row, a middle row and a lower row of bath balls 30. The upper row has three bath balls, the middle row has two bath balls, while the lower row has only one bath ball. With the two decorative sheets 45, the bath utility has an appearance of a fruit.

The bath balls of the present invention can have different colors or sizes. For instance, the middle bath ball 30' of the upper row is brown, while the other bath balls are green. The decorative sheets 45 are also green. Meanwhile, The brown bath ball is larger than the other bath balls.

When using the bath utility 10, the bath balls 30 can absorb a great amount of water or bathing cream for comfortably cleaning a user's skin.

Figure 6:
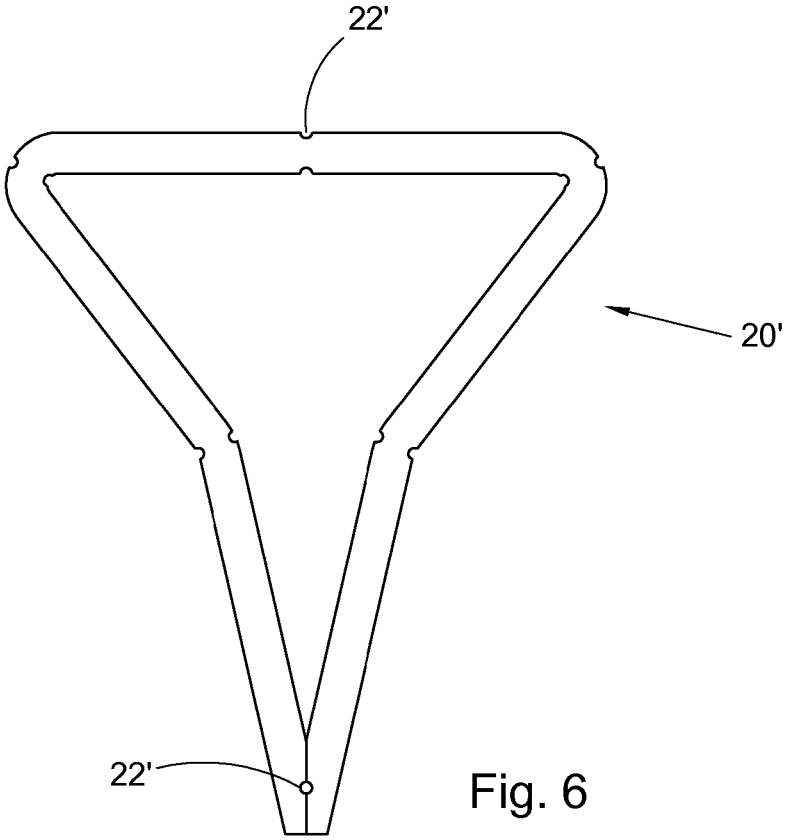
FIG. 6 is a front view of the frame of a second embodiment of the present invention.
Figure 7:
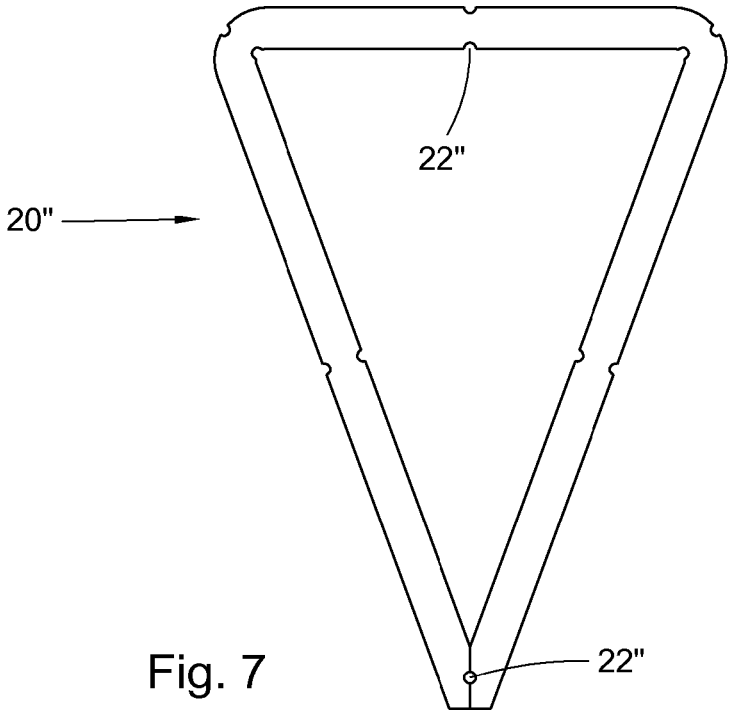
FIG. 7 is a front view of the frame of a third embodiment of the present invention.

FIGS. 6 and 7 respectively show a second and a third embodiments of the present invention, in which only the frames 20', 20" are shown. The frames 20', 20" also have a triangular configuration and are formed with several locating sections 22', 22" for locating the bath balls. The bath balls are connected with these frames 20', 20" to form a bath utility similar to that of FIG. 1.

Figure 8:
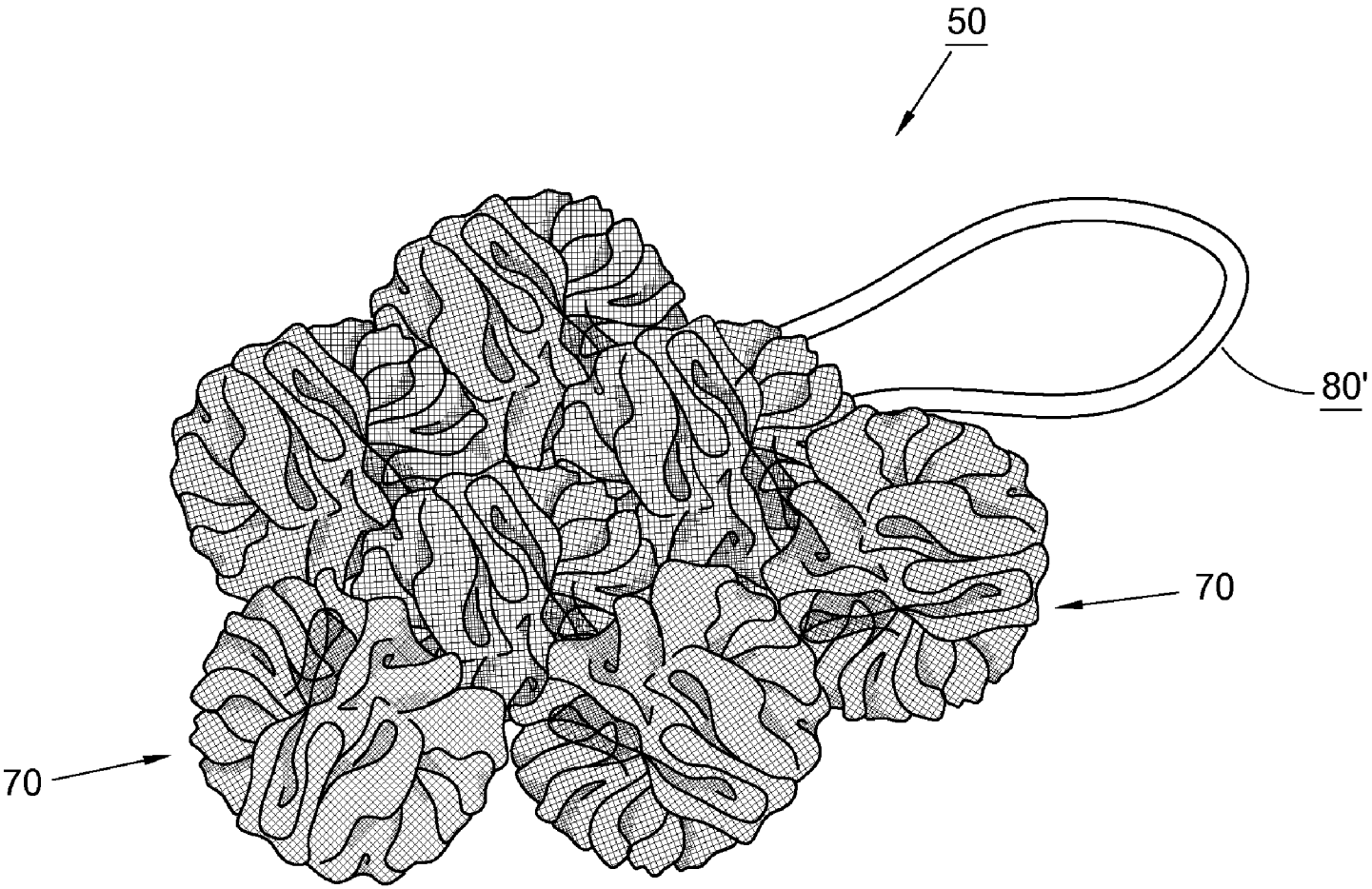
FIG. 8 is a perspective view of a fourth embodiment of the present invention.
Figure 9:
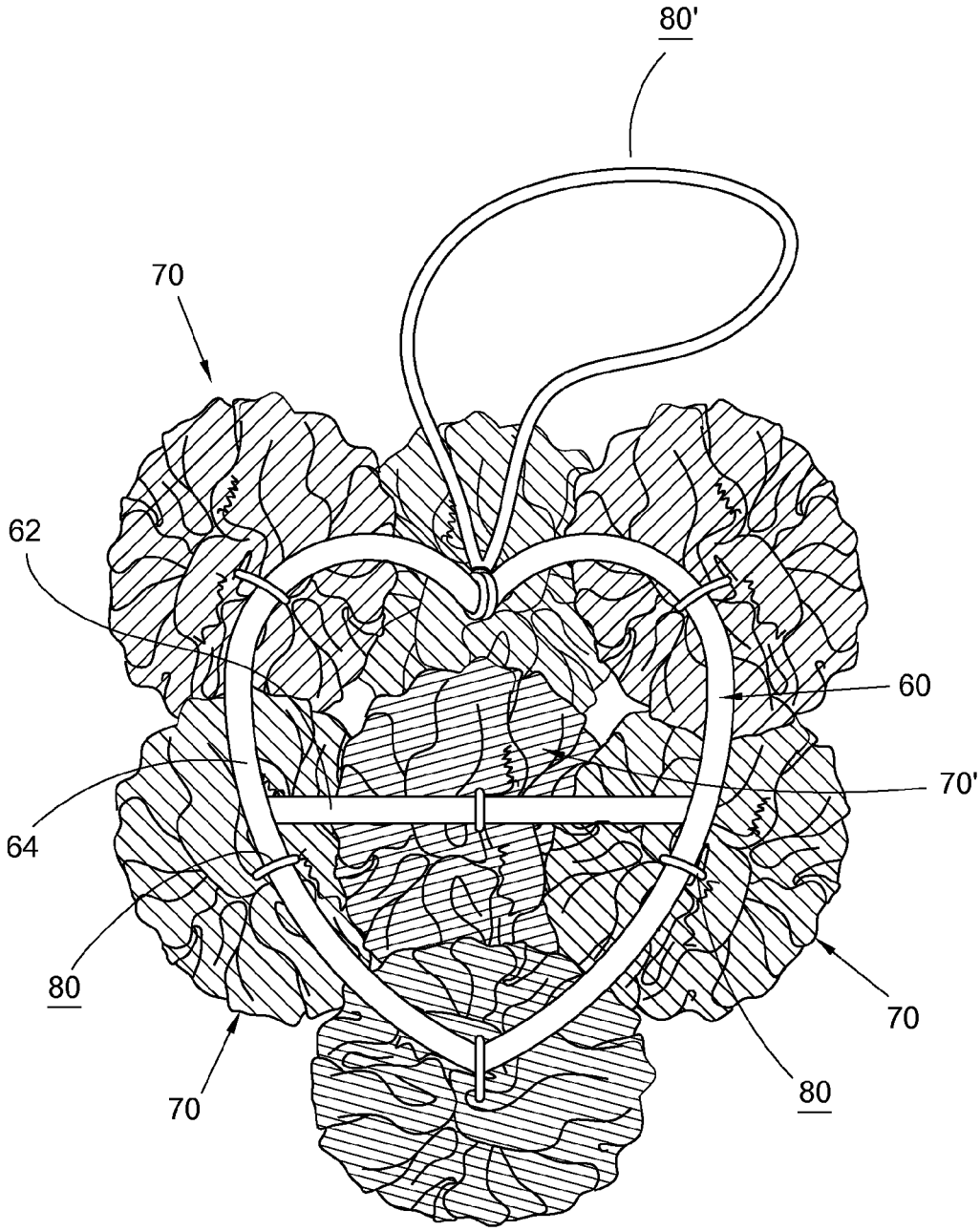
FIG. 9 is a longitudinal sectional view of the fourth embodiment of the present invention according to FIG. 8.

FIGS. 8 and 9 show a fourth embodiment of the bath utility 50 of the present invention, including a frame 60 and several bath balls 70. Each bath ball 70 is tied at a locating section of the frame 60 by means of a binding member 80. The bath balls 70 and the binding members 80, 80' are identical to those of the above embodiment and thus will not be repeatedly described hereinafter.

The frame 60 is a hollow heart-shaped frame body having a wider top end and a narrower bottom end. At least one transverse rod section 62 is mounted in the frame 60. Two ends of the rod section 62 are respectively connected with the two lateral sides 64 of the frame 60. The rod section 62 is formed with at least one locating section (not shown).

Several bath balls 70 are tied at the locating sections of the frame 60 by means of the binding members 80. In addition, at least one bath ball 70' is tied at the locating section of the rod section 62. The bath balls are leant on each other to enclose the frame 60. The upper row can have three or four bath balls respectively fixed on the middle and two sides of the top end of the frame 60. The middle row has three or four bath balls respectively fixed on two lateral sides of the frame and the rod section 62. The lower row has one or two bath balls fixed at the bottom end of the frame. FIG. 8 shows a heart-shaped or fruit-shaped bath utility.

Figure 10:
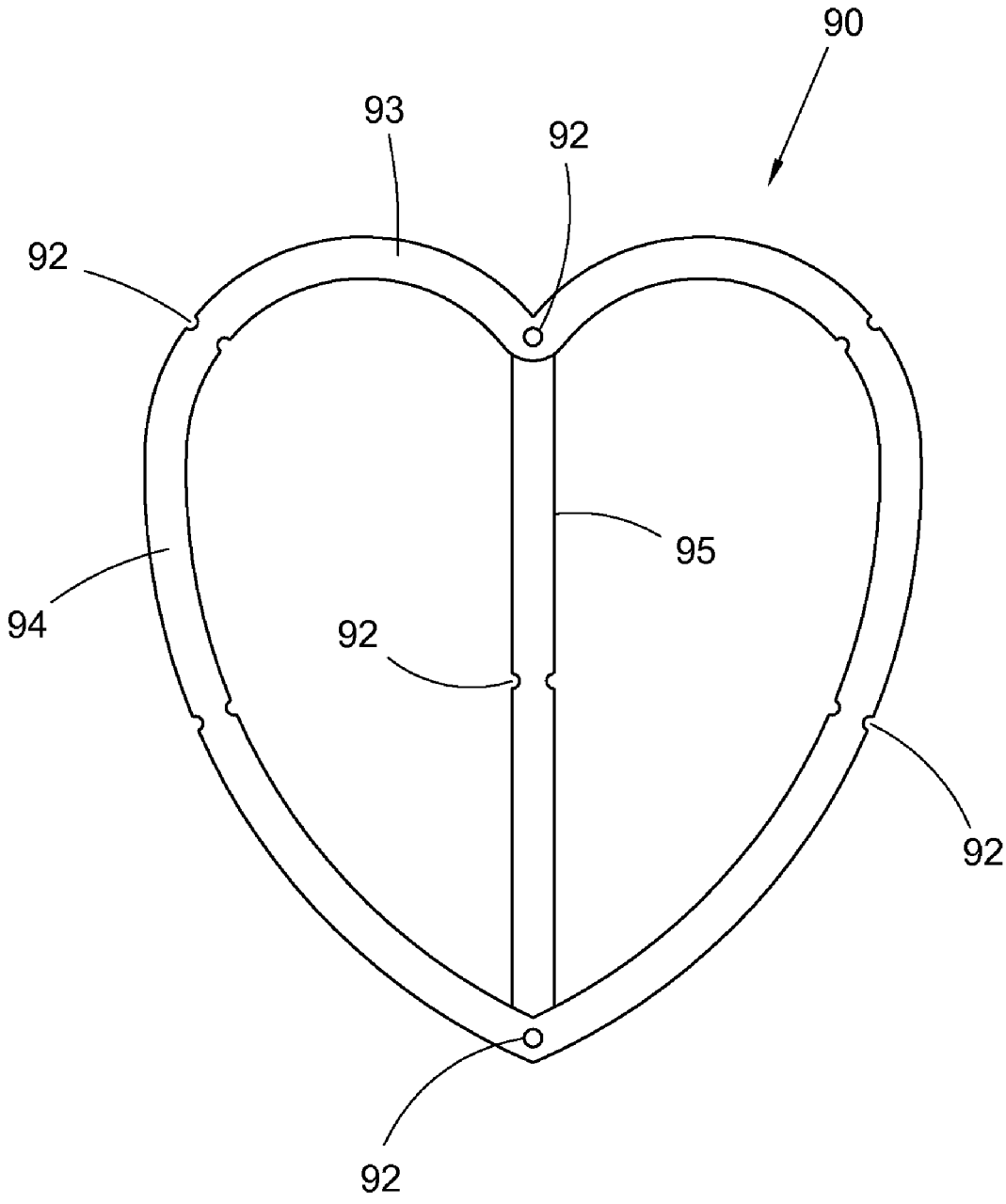
FIG. 10 is a front view of the frame of a fifth embodiment of the present invention.

FIG. 10 shows a fifth embodiment of the present invention, in which only the frame is shown. Several locating sections 92 are respectively formed at the middle and two sides of the top end 93 of the frame 90 and formed on the two lateral sides 94 and the bottom end of the frame 90. A longitudinal rod section 95 is mounted in the frame 90. Two ends of the rod section 95 are respectively fixed with the top end 93 and the bottom end of the frame 90. At least one locating section 92 is formed on the rod section 95. Several bath balls are tied at the locating sections 92 of the frame 90 and the rod section 95 to form a bath utility as shown in FIG. 8.

According to the above arrangement, the bath utility of the present invention has a novel pattern different from the conventional bath utilities. This can stimulate a customer to purchase and use such product.

The above embodiments are only used to illustrate the present invention, not intended to limit the scope thereof.

What is claimed is:

1. A bath utility comprising:

a frame having a predetermined configuration of a wider top end and a narrower bottom end;

the frame is made of a hard material;

several locating sections being formed on the frame at intervals;

a plurality of rows of bath balls being fixed on the frame;

the bath balls which are spongy ball-shaped objects made of plastic mesh tube;

a center of each of the bath balls being tightly bound;

a periphery of the bath balls being bouffant;

a predetermined number of binding members for respectively binding the bath balls at the locating sections of the frame;

the quantity of the bath balls arranged at the top end of the frame being more than the quantity of the bath balls arranged at the bottom end of the frame; and the peripheries of each two adjacent bath balls being leant on each other to hide the frame in the bath balls.

2. The bath utility as claimed in claim 1, further comprising at least one decorative sheet connected with the periphery of one of the bath balls.

3. The bath utility as claimed in claim 1, wherein one of the binding members has a loop section exposed to outer side of the bath utility.

4. The bath utility as claimed in claim 2, wherein one of the binding members has a loop section exposed to outer side of the bath utility.

5. The bath utility as claimed in claim 1, wherein the frame is hollow and has a triangular configuration.

6. The bath utility as claimed in claim 1, wherein the frame is hollow and heart-shaped.

7. The bath utility as claimed in claim 1, further comprising at least one rod section disposed in the frame; at least one locating section being formed on the rod section; at least one bath ball being bound at the locating section of the rod section by means of a binding member.

8. The bath utility as claimed in claim 7, wherein two ends of the rod section are respectively connected with the two lateral sides of the frame.

9. The bath utility as claimed in claim 7, wherein two ends of the rod section are respectively connected with the top end and the bottom end of the frame.

10. The bath utility as claimed in claim 1, wherein each the locating section is a notch.

11. The bath utility as claimed in claim 1, wherein each the locating section is a hole.

12. The bath utility as claimed in claim 1, wherein the bath balls have the same color.

13. The bath utility as claimed in claim 1, wherein the bath balls have different colors.

14. The bath utility as claimed in claim 1, wherein the bath balls have the same size.

15. The bath utility as claimed in claim 1, wherein the bath balls have different sizes.

16. A bath utility comprising:

a frame having a predetermined configuration of a wider top end and a narrower bottom end;

the frame is made of a hard material;

a plurality of rows of bath balls being fixed on the frame;

the bath balls which are spongy ball-shaped objects made of plastic mesh tube;

a center of each of the bath balls being tightly bound, while a periphery of the bath balls being bouffant;

a predetermined number of binding members;

the bath balls being respectively bound on the frame at intervals by the binding members without displacing;

the quantity of the bath balls arranged at the top end of the frame being more than the quantity of the bath balls arranged at the bottom end of the frame; and the peripheries of each two adjacent bath balls being leant on each other to hide the frame in the bath balls.

* * * * *